United States Patent [19]

Jimenez

[11] 4,006,831

[45] Feb. 8, 1977

[54] AUTOMATIC TORTILLA COUNTER AND STACKER

[75] Inventor: James A. Jimenez, Temple City, Calif.

[73] Assignee: Electra Food Machinery, Inc., El Monte, Calif.

[22] Filed: July 28, 1975

[21] Appl. No.: 599,649

Related U.S. Application Data

[63] Continuation-in-part of Ser. No. 448,527, March 6, 1974, abandoned.

[52] U.S. Cl. ..... 214/6 D; 93/93 C; 271/213

[51] Int. Cl.[2] ..... B65G 57/14

[58] Field of Search ..... 214/6 D, 6 H, 6 S; 271/213; 93/93 C, 93 DP

[56] References Cited

UNITED STATES PATENTS

| | | | |
|---|---|---|---|
| 2,424,093 | 7/1947 | Harred | 214/6 D X |
| 2,466,544 | 4/1949 | Harred | 214/6 D X |
| 3,374,902 | 3/1968 | Mills | 214/6 H |
| 3,392,853 | 7/1968 | Mitchell et al. | 214/6 D K |
| 3,525,443 | 8/1970 | Pomara | 214/6 D K |
| 3,777,903 | 12/1973 | Kuckhermann | 214/6 H |

*Primary Examiner*—L. J. Paperner
*Attorney, Agent, or Firm*—James E. Brunton

[57] ABSTRACT

A method of stacking articles and an automatically controlled apparatus for successively receiving articles formed of rigid or semirigid sheet material such as cooked or partially cooked tortillas or similar food products, automatically formed orderly stacks of a predetermined number of articles, and then automatically carrying away for packaging each stack when completed.

3 Claims, 5 Drawing Figures

FIG. 3.
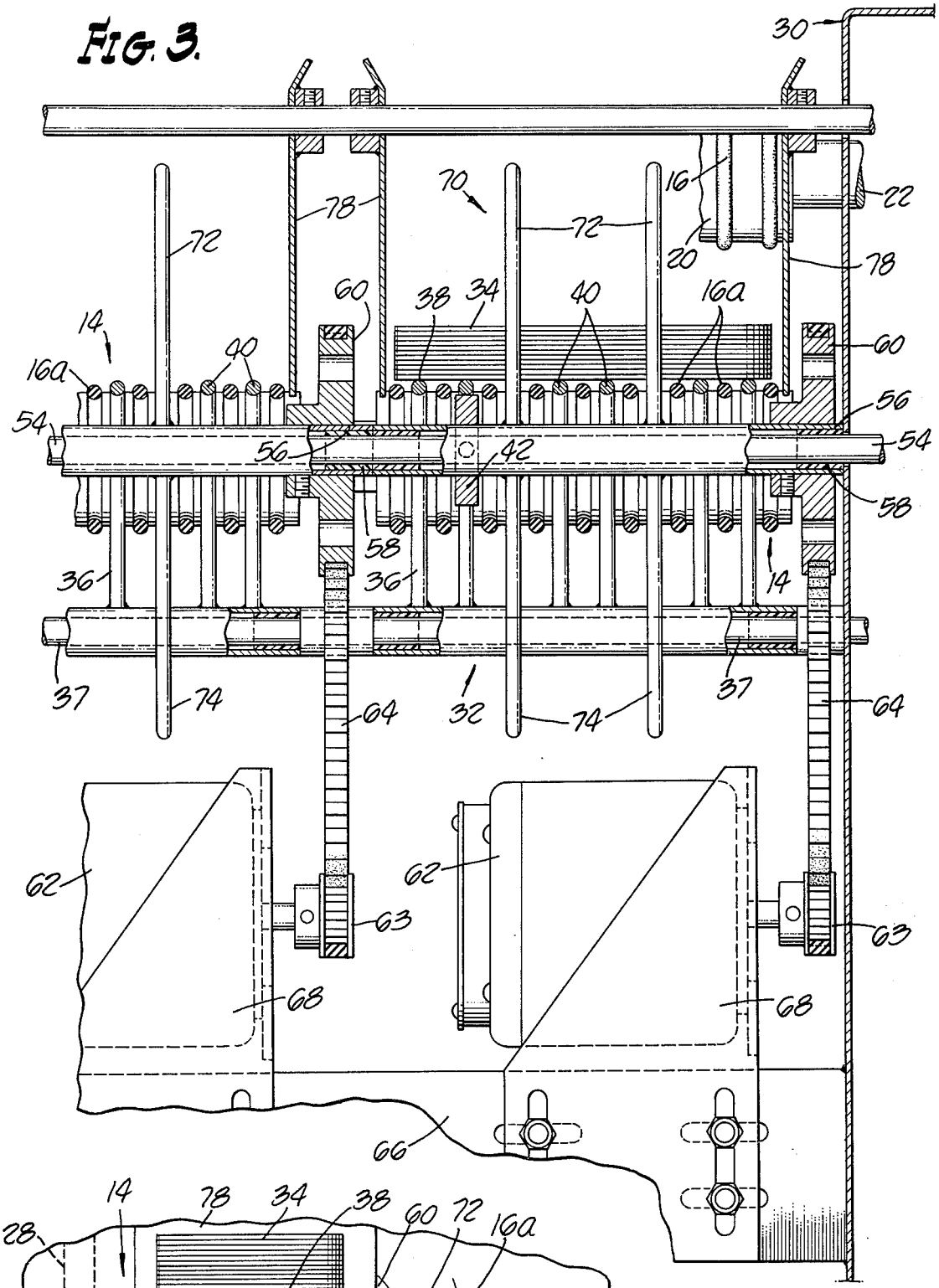
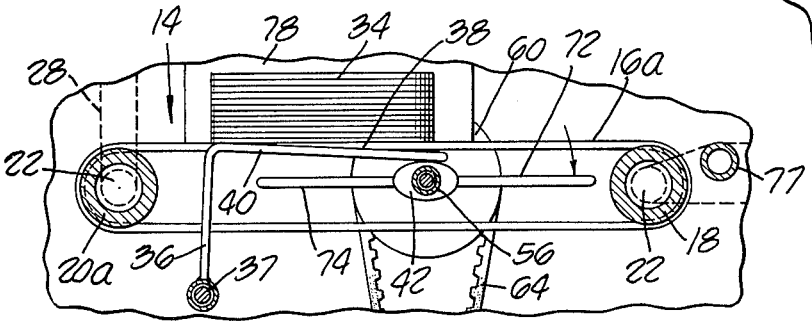
FIG. 4.

AUTOMATIC TORTILLA COUNTER AND STACKER

This Application is a Continuation-in-Part of Application Ser. No. 448,527, filed Mar. 6, 1974, now abandoned.

BACKGROUND OF THE INVENTION

1. Field of the Invention

This invention relates generally to a method and an apparatus for automatically counting and stacking generally planar-shaped articles delivered to the apparatus in succession. More particularly the invention relates to a method and an apparatus for automatically counting and stacking cooked or partially cooked tortillas or similar food products into groups of a predetermined number for packaging and shipment.

2. Discussion of the Prior Art

Various article stacking methods and types of article stacking apparatus have been developed in the past. Typically the prior art devices comprise a conveyor system adapted to transport rigid articles, such as tile, brick and the like to a vertically movable platform. As the object is received on the platform, the platform is lowered to make way for the next article which is slid into position on the preceding article. After a stack of objects has been formed in this manner, a second conveyor is generally provided to carry the stack away to a shipping area. The patent to U. Walchhuter, U.S. Pat. No. 3,366,253, describes an apparatus of this general type.

Where the articles to be stacked are in the form of semirigid sheet material, such as tortillas or similar food products, special stacking problems are encountered. For reasons of sanitation as well as operational efficiency, it is essential that the product not be directly handled by the operator at any time throughout the cooking or other preparatory cycle, the stacking operation or the transfer and packing operations. The apparatus, therefore, must be highly reliable and fully automatic. Additionally, because of the lightweight, semirigid and fragile character of food products, such as tortillas, prior art stacking techniques designed for the stacking of rigid, stable, heavier weight articles have generally proved unsatisfactory.

For example, stacking methods in which the articles to be stacked must slide upon one another are unacceptable because such methods would fold, tear, abrade or otherwise damage the fragile food products.

The patents to Mitchell et al., U.S. Pat. No. 3,392,853 and to J. P. Pomara, Jr., U.S. Pat. No. 3,525,443, are illustrative of prior art apparatus used for stacking objects such as tortillas. As will become apparent from the description which follows, these devices operate in an entirely different manner from the apparatus of applicant's invention.

Additionally, as will become apparent from the description which follows, one of the principal advantages of the apparatus of the present invention over prior art counting and stacking machines is its high speed of operation. Because of the complexity and operating delay times of the object stacking mechanisms, most prior art devices are significantly limited in the number of objects which can be received from the input conveyor. For example, in devices utilizing hydraulically operated receiving pans of the type exemplified by U.S. Pat. No. 3,525,443, the frequency with which units can be received from the input conveyor for stacking is limited by the time required for the receiving pans to be moved from a receiving position to a retracted position and back to a receiving position. After a stack of the desired number of articles is completed additional time delay is built into the system to enable the stack to be transferred to the output conveyor for removal from the stacking area.

The unique design of the present apparatus virtually eliminates time delays due to operation of the article receiving and stacking mechanism of the device. The objects to be stacked are received from the input conveyor directly onto a receiving surface and are automatically aligned. When the stack is completed, the articles are expeditiously transferred to the output conveyor for removal from the stacking area by means of a novel cam and cooperating locating arm arrangement which revolves as a unit to simultaneously lower a first set of locating arms and bring the articles into engagement with the output conveyor.

Continued rotation of the unit immediately brings a second set of locating arms into position to receive articles from the input conveyor and locate them on the receiving surface. This novel construction eliminates article overshoot and permits rapid and continuous feeding of articles onto the receiving surface of the stacking mechanism.

In addition to the patents previously identified, the following patents comprise pertinent prior art known to applicant:

| | |
|---|---|
| 1,661,969 - Semashko | 2,606,483 - Forbes, Jr. |
| 2,789,709 - Shields | 2,825,475 - Roberts |
| 3,014,599 - Lawrence, et al. | 3,306,475 - Mays |
| 3,291,010 - Williamson | 3,205,794 - Califano, et al. |
| 3,374,902 - Mills | 3,393,645 - Mason, Jr. |
| 3,533,517 - Heide | |

SUMMARY OF THE INVENTION

It is an object of the invention to provide an apparatus of simple construction for successively receiving at a very high rate pieces of rigid or semirigid sheet material, accurately and automatically forming orderly stacks of predetermined numbers of the pieces of the sheet material, and then automatically carrying away each stack when completed so as to make way for the building of the next stack.

More particularly it is an object of the invention to provide a novel method of stacking food products such as tortillas and an apparatus of the aforementioned character in which, without the necessity of operator handling, generally planar-shaped food products such as tortillas and the like can be automatically transported successively to the apparatus for automatic counting, orientation and stacking into groups of predetermined numbers for later packaging.

It is another object of the invention to provide an apparatus of the class described in the preceding paragraphs in which a sensor is provided to sense the receipt of each article and to concomitantly cause the generation of a signal for selective transmission to the drive means of an article receiving and stacking mechanism of the apparatus.

It is still another object of the invention to provide an apparatus as described in the preceding paragraph in which the sensor includes a photoelectric sensing and signal generation circuit which is electrically interconnected with the article receiving mechanism, the counter and the removal mechanism, and in which the counter mechanism of the apparatus is adjustable so as to enable control of the number of articles which will be stacked into a single group.

It is another object of my invention to provide a method of stacking articles which comprises moving the articles onto a supporting surface, orienting them into a fixed position and then dropping them sequentially vertically downward onto a second support means of an article receiving and stacking mechanism of the apparatus.

It is another object of the invention to provide a method and an apparatus of the type described in which tortillas or similar food products can be stacked directly one upon another in orderly groups without any frictional interaction between the tortillas which would tend to fold, tear, abrade or otherwise damage them.

It is a further object of the invention to provide an apparatus of the type described in the preceding paragraph in which a removal conveyor is operatively associated with the tortilla receiving rack so that when a predetermined number of tortillas have been stacked thereon the stack will be automatically moved to a packaging and removal station, thereby making way for the forming of the next stack.

It is another object of the invention to provide an apparatus as previously described which is of highly simple construction, embodies a minimum number of components, is very reliable and can be manufactured much more inexpensively than similar prior art article stacking apparatus.

In summary, the apparatus of my invention for stacking articles comprises a first transport means or supply conveyor for moving the articles to be stacked forwardly of the apparatus singly in line with each article succeeding a preceding article; an article receiving rack adapted to successively receive the articles from the supply conveyor, said receiving rack being movable from a first position to receive the articles to a second position to dispense the articles; a sensor adapted to sense the passage of each article toward the receiving rack and thereupon generate a transmitting signal; an actuating mechanism responsive to signals transmitted by said sensor and operatively coupled with said receiving rack for moving said receiving rack from a first position to a second position in response to signals transmitted by said sensor; aligning elements movable to said receiving rack for aligning the articles on the receiving rack when the receiving rack is in a first position; and a second transport means or removal conveyor cooperatively associated with the receiving rack for moving the articles forwardly of the apparatus when the receiving rack is moved into a second position.

BRIEF DESCRIPTION OF THE DRAWINGS

FIG. 3 is a view taken along lines 3—3 of FIG. 2, partly broken away to show internal construction.

FIG. 4 is an enlarged fragmentary view showing the article receiving rack in its lowered position so as to enable the stacked objects to be carried by the lower conveyor to the packaging station.

DESCRIPTION OF ONE EMBODIMENT OF THE INVENTION

Figure 1:
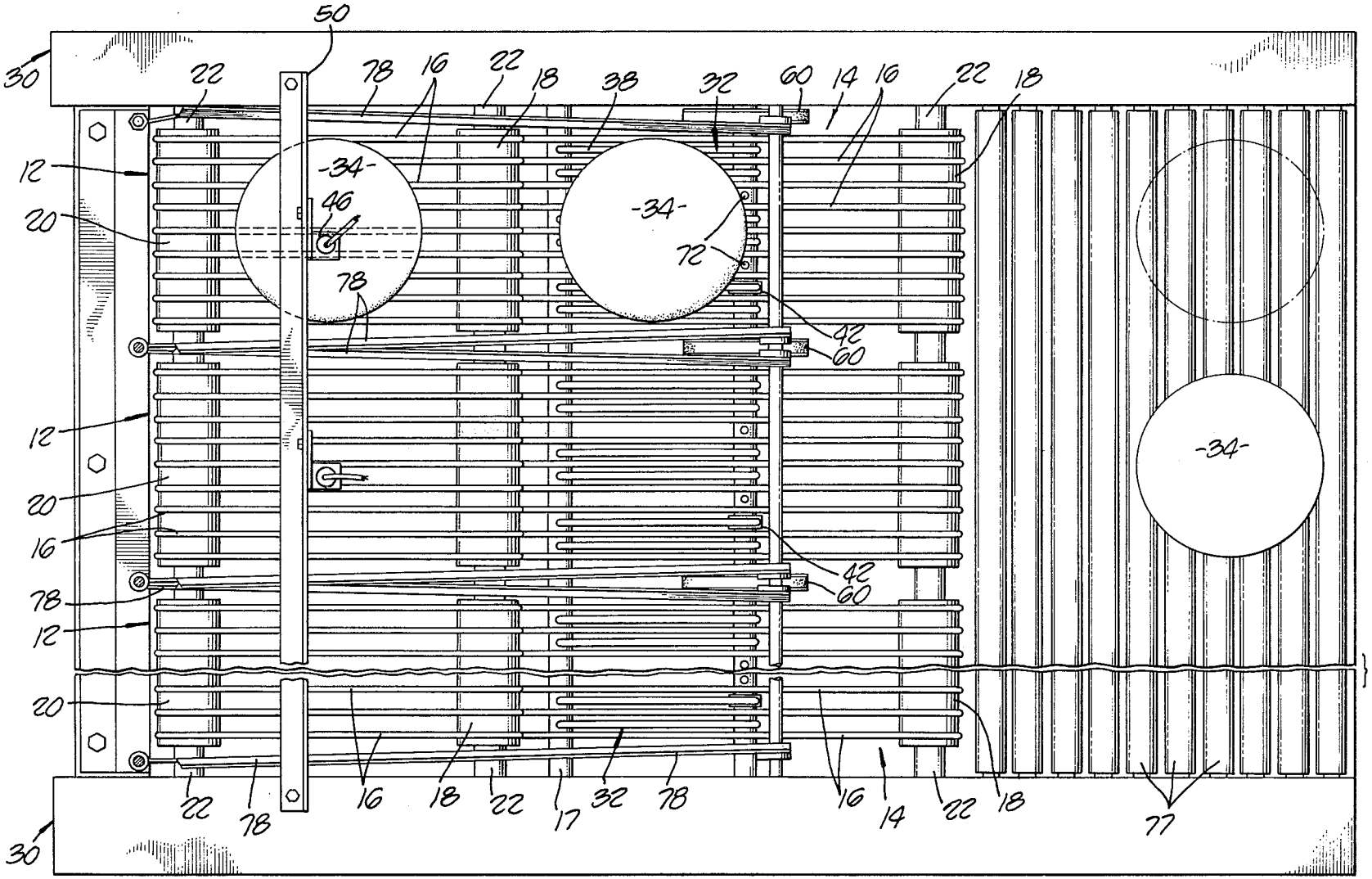
FIG. 1 is a plan view of the apparatus foreshortened for ease of illustration.
Figure 2:
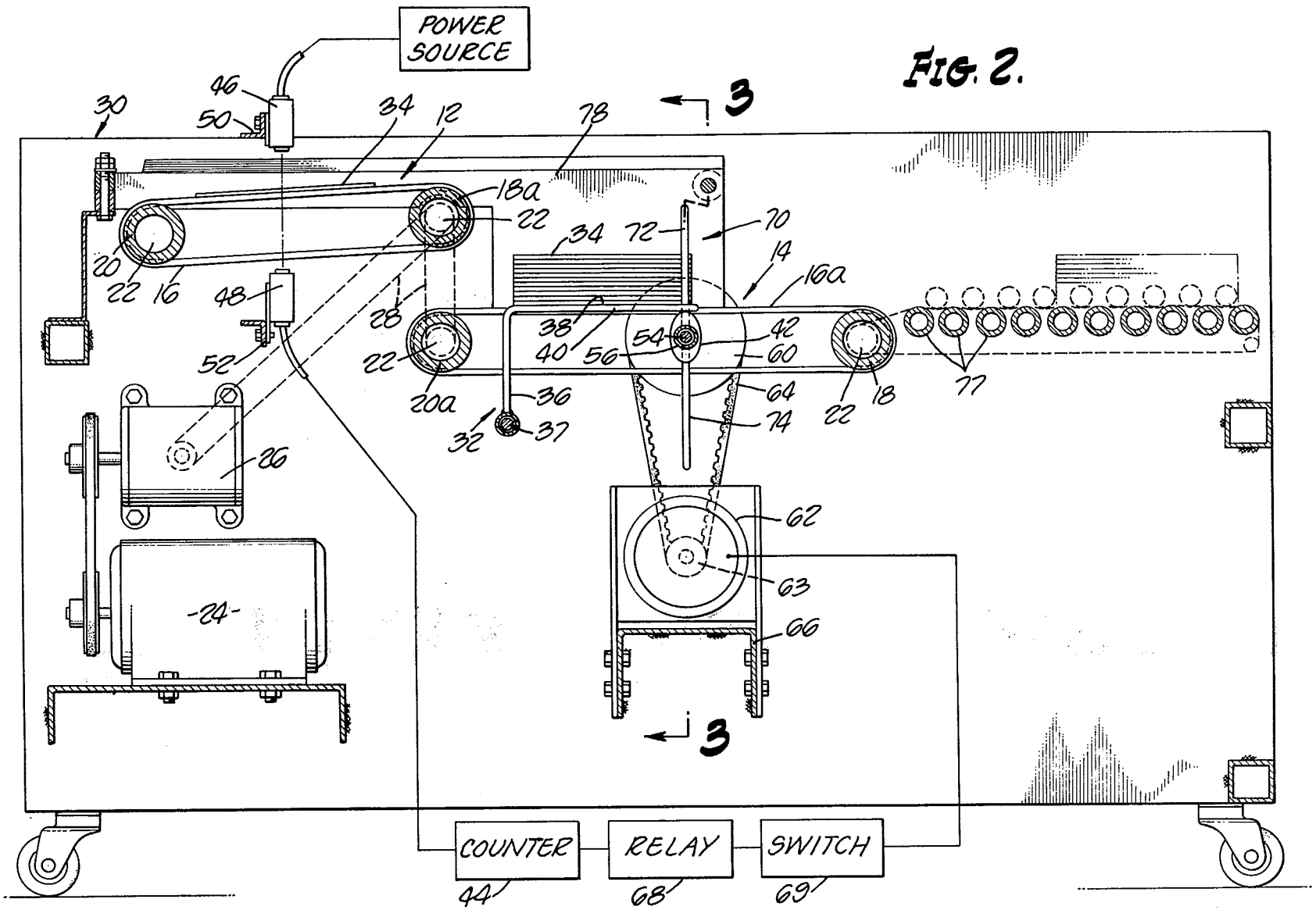
FIG. 2 is a side elevational view of the apparatus, partly in section, illustrating the relative arrangement of the various operating subsystems of this embodiment of the invention, and including schematic disclosure of the electric circuitry provided in conjunction with the sensor means of the apparatus.

Referring to the drawings and particularly to FIGS. 1 and 2, the apparatus of the invention can be seen to comprise a series of first article transport, or conveyor means 12, disposed in a side-by-side relationship for moving articles such as tortillas singly in line along each conveyor means in a direction forwardly of the apparatus. Disposed in advance of and below each of the first conveyor means is a second article transport, or conveyor means 14, for moving the articles forwardly of the apparatus after they have been stacked, in a manner presently to be described.

The first and second transport means 12 and 14 are of similar construction, each comprising a plurality of spaced apart article carrying elements in the form of endless belts 16 arranged in frictional engagement with forward and rear rollers, or drums 18 and 20 respectively, which are rotatably carried on substantially parallel shafts 22.

As best seen in FIG. 2, the forward roller 18*a* of the first conveyor means 12 and the rear roller 20*a* of the second conveyor means 14 are suitably interconnected with and rotatably driven by a first drive means, shown here as comprising an electric motor 24; an operatively associated gear reduction mechanism 26; and driving belts 28 suitably interconnecting the gear reduction mechanism with drums 18*a* and 20*a*. Shafts 22 are rotatably carried by a superstructure or framework generally identified in the drawings by the numeral 30, upon which is also mounted the first drive means.

Disposed intermediate each second conveyor means 14 is an article receiving means, generally indicated as 32. The article receiving means is adapted to successively receive articles from the first transport means 12. In the embodiment of the invention illustrated in the drawings, the articles are shown in the form of tortillas, designated by the numeral 34. The article, or tortilla receiving means 32, is shown here as comprising a pivotally mounted rack 36 (FIG. 2) having a supporting surface 38 which is defined by a plurality of spaced apart tortilla carrying elements or fingers 40 (FIG. 3).

Upon pivotal movement of the rack 36 about a horizontally disposed shaft 37 (FIG. 2), the supporting surface 38 is moved from a first substantially horizontal article receiving position as shown in FIG. 2, wherein the tortillas disposed thereon are spaced apart from the second conveyor means 14, to a second inclined article dispensing position as shown in FIG. 4, wherein the tortillas disposed thereon are moved into frictional engagement with belts 16a of second conveyor means 14.

As best seen by referring to FIGS. 1, 2 and 4, the spaced apart fingers 40 of racks 36 are so constructed and arranged as to interleaf between the tortilla carrying elements or belts 16*a* of the second conveyor means upon pivotal movement of the rack from its first to its second position. Movement of racks 38 is controlled by the rotation of a cam arrangement indicated in the drawings (FIG. 2) by the numeral 42. Cam 42 forms a part of the actuating means of the invention, the details of construction and operation of which will presently be discussed.

Turning particularly to FIG. 2, the apparatus of the invention can be seen to also include sensor means associated with each of the in-line conveyor systems. The sensor means are adapted to sense the passage of each tortilla 34 toward the receiving means, or rack 36, and to thereupon generate and transmit a signal to a counter means 44 operatively associated therewith and forming a part of the actuating means of the apparatus.

In the form of the invention here illustrated, each sensor means is shown as comprising photoelectric circuit means including cooperating sources of light 46 and photoelectric cells 48 arranged relative to the first conveyor means 12 in such a manner that light emanating from the sources of light is prevented from reaching the cooperating photoelectric cells whenever articles pass forwardly of the apparatus toward the receiving means. Sources of light 46 are mounted on a length of angle iron 50 which extends transversely of framework 30 intermediate the first conveyor means 12. The sources of light are centered relative to the paths traversed by the articles, such as tortillas 34, as they pass from the first conveyor means to the receiving means. Photoelectric cells 48 are mounted on a length of angle iron 52 extending transversely of framework 30, and are positioned below the upper surface of first conveyor means 12 in direct alignment with their cooperating light source.

The purpose of the sensors is to detect articles such as tortillas, passing toward the receiving means and to appropriately activate the actuating means of the invention with which they are cooperatively associated so as to cause the receiving means or rack 36 to be moved from its first to its second position. It is to be appreciated that a wide variety of sensing means other than photoelectric sensors could be used to accomplish this purpose. For example, various types of mechanical and fluid operated sensing mechanisms well known in the art could be coupled with the actuating means and used in place of the photoelectric sensors to sense the passage of articles and to activate the actuating means.

The actuating means of the embodiment of the invention shown in the drawings is operatively coupled with the sensor means and functions to selectively move the receiving means of each in-line conveyor system from a first to a second position. In addition to cams 42, the actuating means comprise a fixed shaft 54 carried by framework 30 and for each in-line conveyor system, a tubular member 56 rotatable about bearings 58 carried by shaft 54. Connected to the right end of each member 56 (FIG. 3) is a sprocket wheel 60 interconnected with and driven by a second drive means, shown here as comprising for each in-line conveyor system an electric motor 62, a motor drive sprocket 63, and a drive belt 64 (FIG. 2).

As illustrated in FIG. 2, each motor 62 is carried by a motor mount 66 supported by framework 30. As can also best be seen in FIG. 2, cams 42 are connected to and are rotatable with tubular members 56 upon energization of motors 62. Referring to the schematic portion of FIG. 2, it can be seen that each motor 62 is operatively interconnected with a sensor means through a counter 44, a relay 68 and a switch 69, the functions of which will presently be discussed.

The aligning means 70 of this embodiment of the invention are disposed proximate each rack 36 of the receiving means and are movable relative thereto. As illustrated in FIG. 2, the aligning means function to longitudinally align the tortillas carried on surface 38 of the receiving means when rack 36 is in its first position. Referring to FIG. 3, aligning means 70 can be seen to comprise for each in-line conveyor system first and second pairs of oppositely extending spaced apart arms 72 and 74 respectively, which are affixed to and are rotatable with a tubular member 56.

By referring particularly to FIG. 3, it can be seen that arms 72 and 74 are positioned intermediate fingers 40 of racks 36 and also intermediate belts **16*a* of the second conveyor means so that upon rotation of members 56 the aligning means can rotate freely through a complete 360°. As also illustrated in FIG. 3, the cams 42 can be seen to be disposed in engagement with one of the spaced apart fingers 40 of each of racks 36 in such a manner that upon rotation of members 56 and cams 42 the supporting surfaces 38 of racks 36** will move pivotally upwardly and downwardly relative to the second conveyor means.

Disposed forwardly of the second conveyor means of the apparatus is a series of parallel rollers 77 which cooperate to form a prepackaging location for the stacked tortillas.

It is to be understood that although the drawings illustrate three side-by-side in-line conveyors or operating systems, each comprising cooperating first and second conveyor means, receiving means, sensor means and actuating means, any number of systems can be assembled together to form an article counting and stacking apparatus falling within the scope of the invention.

OPERATION

Because each of the side-by-side in-line conveyor systems of the apparatus of the invention as shown in the drawings functions in an identical manner, the operation of only one of the in-line conveyor systems will be described.

Following energization of motor 26 of the first drive means to activate the first and second transport means 12 and 14, articles to be counted and stacked, such as tortillas, are introduced into the apparatus by placing them onto belts 16 of first transport means 12. This can be done either by hand or by appropriate interconnection of the apparatus with the onput conveyor of another apparatus which, for example, may be used in the manufacture of the article.

As the articles move forwardly of the apparatus they will be centered transversely of the first conveyor means by a centering means shown in the drawings in the form of a pair of guide rails 78 (FIG. 1) carried by framework 30. Upon reaching the forward extremity of the first conveyor or transport means 12, the articles will fall by gravity onto the supporting surface 38 of rack 36 which, at this time, is in a first or article receiving position. As illustrated in FIG. 2, the forward velocity of the articles will cause them to engage the vertically extending locating arms of the aligning means, in this case arms 72, and form into neatly aligned stacks. It is to be noted that the rack 36 held in the position shown in FIGS. 2 and 3 by cam 42, the belts 16a of the second transport means 14 will move freely beneath the stacked articles.

As each article passes forwardly of the first conveyor means and beneath light source 46 of the sensor means, the light beam which is directed toward photoelectric cell 48 (FIG. 2) will be interrupted and an electrical signal will be generated and transmitted to counter 44. After a predetermined number of such signals are received by the counter, a signal will be transmitted to relay 68 which will activate switch 69 and in turn energize motor 62 for a predetermined time interval.

The counter 44, which is of a type well known in the art, can be preset to transmit a signal to the relay upon passage of the number of articles desired to be contained in the stack. The interconnection of the various electrical components schematically depicted in FIG. 2 is also well known in the art and will not be discussed in detail herein.

Energization of motor 62 will cause rotation of sprocket wheel 60 and member 56 about shaft 54. This, in turn, will cause rotation of cam 42 and locating arms 72 and 74, all of which are connected to member 56.

When member 56 has rotated through an arc of approximately 90°, cam 42 and arms 72 and 74 will be moved from the position shown in FIG. 2 into the position shown in FIG. 4. This causes rack 36, which is supported by cam 42, to pivot about shaft 37 into its second or dispensing position as shown in FIG. 4, wherein fingers 40 interleaf with belts 16*a* of the second transport means. As rack 36 is lowered into this position, the stacked articles are moved into frictional engagement with belts 16*a*.

The 90° rotation of member 56 simultaneously causes arms 72 and 74 to rotate from a generally vertical orientation into a generally horizontal orientation, thereby permitting the stacked articles to be moved forwardly of the apparatus by the second transport means. As shown in FIG. 2. when the stacked articles reach the end of the second transport means, they will be moved onto rollers 77 to await packaging.

Continued rotation of member 56 by motor 62 through an additional 90° will cause rack 36 to be lifted by cam 42 once more into its elevated first or article receiving position. At the same time, locating arm 74 will move into a vertically extending position for engagement by the next article traveling toward the receiving means. With the cam, receiving means and aligning means of the invention thus oriented, motor 62 will be automatically de-energized and the mechanism will remain in this position until the cycle is repeated by transmission of another signal to motor 62 by counter 44.

Repetition of the cycle thus described enables automatic and continuous stacking of articles such as tortillas into stacks containing a predetermined number of articles.

Figure 5:
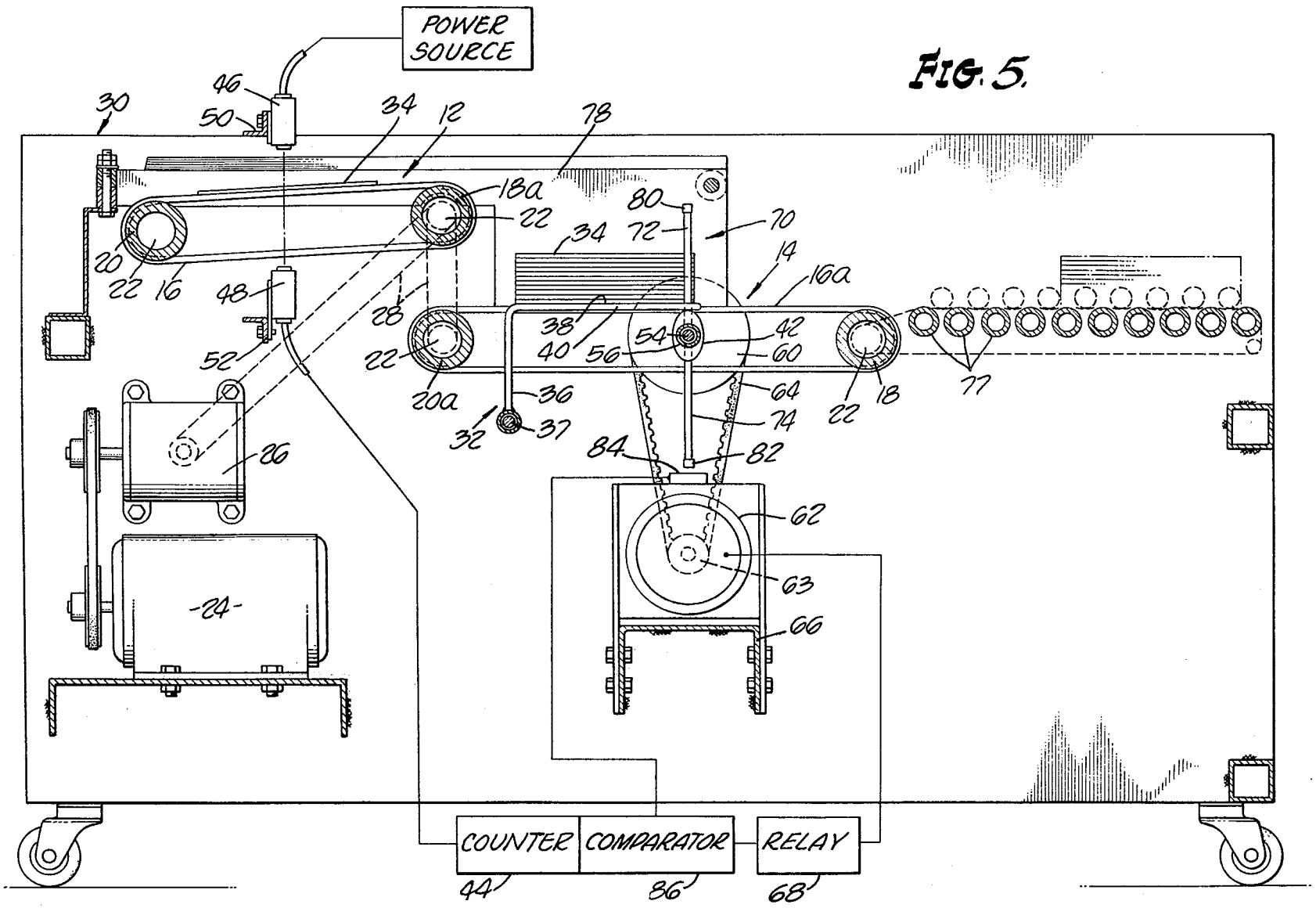
FIG. 5 is a side elevational view of another embodiment of the apparatus of the invention partly in section illustrating the relative arrangement of the various operating subsystems of this form of the invention.

Referring to FIG. 5, there is shown a modified construction of the apparatus of the invention. Because of the similarity of various elements of the apparatus and the functions thereof, elements of this form of the invention which are the same as elements of the apparatus previously described are designated by corresponding numerals. Also because of the similarity of function it will not be necessary to describe all of the details of construction of the modified apparatus as was done in connection with the apparatus shown in FIGS. 1–4.

As illustrated in FIG. 5, each motor 62 of this form of the invention is carried by a motor mount 66 supported by framework 30. Cams 42 are connected to and are rotatable with tubular members 56 upon energization of motor 62. Referring particularly to the schematic portion of FIG. 5, it can be seen that in this construction each motor 62 is operatively interconnected with a sensor means through a counter 44 which embodies a comparator 86, through a relay 68, and through a magnetically responsive means in the form of a magnetically operated proximity switch 84, the functions of which will presently be discussed.

It is to be noted that in this form of the invention spaced apart arms 72 and 74 which comprise a part of aligning means 70 are provided with magnets 80 and 82 respectively, affixed at the extremities of the spaced apart arms. Magnets 80 and 82 serve to activate proximity switch 84 in the manner now to be described.

With the apparatus in the position illustrated in FIG. 5, articles 34 will pass forwardly of the first conveyor means beneath light source 46 and thence onto the stack of articles supported on rack 36. As each article passes beneath light source 46, the light beam which is directed toward photoelectric source 48 will be interrupted and an electrical signal will be generated and transmitted to counter 44. After a predetermined number of such signals are received, comparator 86 will trigger relay 68, energizing motor 62. This will cause rotation of sprocket wheel 60 and member 56 about shaft 64. This, in turn, will cause rotation of cam 42 at locating arms 72 and 74, all of which are connected to member 56. A 90° rotation of member 56 will cause arms 72 and 74 to rotate from a generally vertical orientation into a generally horizontal orientaton, and will cause cam 42 to lower rack 36, permitting the stacked articles to be moved forwardly of the apparatus by the second transport means. Continued rotation of member 56 will cause rack 36 to be lifted by cam 42 into its elevated position. At the same time, locating arm 72 will move toward a vertically downwardly extended position and magnet 80 affixed thereto will move into operable communication with the magnetically responsive means or proximity switch 84 so as to actuate the switch in a manner well understood by those skilled in the art. Switch 84 is interconnected with comparator 86 so that when actuated, a signal will be transmitted to the comparator which, in turn, will drop out or de-energize the relay, stopping motor 62. By properly positioning proximity switch 84 within the apparatus, it is possible to stop the motor 62 so that arms 72 and 74 will be stopped in a plane substantially perpendicular to the plane containing conveyor belt 16*a*. During the succeeding cycle, magnet 82 affixed to arm 74 will move into operable communication with the proximity switch to once again stop the motor at the precise time to once more ensure stopping arms 72 and 74 in a vertical relationship with respect to the plane of conveyor belt 16*a*. This arrangement permits the processing of the articles at very high rates of speed without undesirable "overshoot" of the blocking arms.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for stacking semi-rigid generally planar shaped articles comprising:

a. first conveyor means for sequentially receiving the articles to be stacked and moving them forwardly of the apparatus;

b. a second conveyor means disposed forwardly of and below said first conveyor means for moving the articles forwardly of the apparatus, said second conveyor means comprising a plurality of spaced apart article-carrying belts;

c. a pivotally mounted rack disposed proximate said second conveyor means and having a plurality of spaced apart fingers defining an article receiving surface, said rack being pivotally movable from a first article receiving position wherein said fingers are substantially horizontal to a second article dispensing position wherein said fingers are inclined and interleaf between said belts of said second conveyor means;

d. means for moving said rack from a first position to a second position including a rotatable shaft, motor means for rotating said shaft and a cam connected to said shaft, said cam being rotatable through 360° and disposed in operative engagement with at least one finger of said rack and being adapted to pivotally move said rack from the first position to the second position upon rotation of said cam;

e. first and second oppositely extending locating arms connected to said rotatable shaft and rotatable therewith through 360°, said arms being movable from a first position wherein said arms are substantially normal to the plane of said fingers of said rack in its first position to a second position wherein said arms are substantially parallel to the belts of said second conveyor means;

f. magnets affixed to the extremities of said first and second locating arms;

g. sensor means adapted to sense the passage of each article toward said rack and to thereupon generate and transmit a signal;

h. counter means operatively associated with said sensor means for receiving and counting signals transmitted thereby and for transmitting signals to said motor means upon receipt of a predetermined number of signals from said sensor means to activate said motor means to rotate said shaft; and i. magnetically responsive means operably interconnected with said motor for stopping said motor when said magnets move into operable communication with said means.

2. The apparatus as defined in claim 1 in which said magnetically responsive means comprises a magnetically operated proximity switch.

3. A tortilla stacking and counting apparatus comprising:

a. a first conveyor means for sequentially receiving tortillas and moving them forwardly of the apparatus;

b. a second conveyor means disposed forwardly of and below said first conveyor means for moving tortillas forwardly of the apparatus;

c. a tortilla receiving means disposed proximate said second conveyor means for sequentially receiving tortillas from said first conveyor means, said receiving means including a tortilla supporting surface pivotally movable relative to said second conveyor means from a first position wherein the tortillas disposed thereon are spaced apart from said second conveyor means to a second position wherein the tortillas disposed thereon are movable into frictional engagement with said second conveyor means;

d. actuating means for moving said receiving means from a first position to a second position including a rotatable shaft, motor means for rotating said shaft and a cam connected to said shaft said cam being disposed in operative engagement with said receiving means and adapted to move said supporting surface from the first position to the second position upon rotation of said cam; and e. aligning means for aligning the tortillas on said receiving means longitudinally of the apparatus, said aligning means comprising:

1. first and second oppositely extending locating arms connected to said shaft;
2. magnets affixed to the extremities of said locating arms; and
3. magnetically responsive means operably interconnected with said motor means for stopping said motor when said magnets move into operable communication with said magnetically responsive means.

* * * * *